United States Patent [19]

Sewell

[11] 4,033,655

[45] July 5, 1977

[54] GROUNDABLE LAMP RECEPTACLE

[76] Inventor: William Sewell, 205 Outer Drive, Oak Ridge, Tenn. 37830

[22] Filed: Aug. 30, 1976

[21] Appl. No.: 719,067

[52] U.S. Cl. ..... 339/14 R; 339/59 L; 339/140 R

[51] Int. Cl.[2] ..... H01R 3/06

[58] Field of Search ..... 339/14 R, 59 L, 138, 339/139 R, 140 R, 143 R, 176 L, 184 L, 278 L

[56] References Cited

UNITED STATES PATENTS

| | | | |
|---|---|---|---|
| 1,974,049 | 9/1934 | Hubbell, Jr. | 339/140 R X |
| 2,001,317 | 5/1935 | Slady | 339/140 R |
| 3,153,119 | 10/1964 | Hart | 339/59 L X |

*Primary Examiner*—Roy Lake
*Assistant Examiner*—DeWalden W. Jones
*Attorney, Agent, or Firm*—Martin J. Skinner

[57] ABSTRACT

An improved metallic lamp socket enclosure of the cap-and-shell type for incandescent lamps is disclosed. According to the invention, the cap portion of the unit is provided with integral means for attaching a ground wire for safety purposes. The invention may be applied to units as they are manufactured or to previously manufactured units.

A tool for forming the grounding means, and for effecting the attachment of a ground wire thereto, is also described.

5 Claims, 6 Drawing Figures

GROUNDABLE LAMP RECEPTACLE

BACKGROUND OF THE INVENTION

Essentially all electrical codes for industrial and residential wiring require the use of a grounding wire for all circuits. This requirement applies to outlet receptacles, such as wall plugs, and the units installed therein have provisions for receiving a grounding prong from any electrical appliance, tool, etc., to be energized at that outlet. As a further safety factor, most appliances, tools, etc., are now provided with a three-wire cord and plug, with the ground wire being attached to the case of the unit, whereby the case is connected to the circuit ground during use. This prevents shocks to an operator in the event of an insulation failure.

One electrical appliance, however, that has not been adapted for a ground wire is the incandescent lamp socket as utilized for table lamps, floor lamps, pull-down lamps and the like. A conventional cap-and-shell socket unit has been universally utilized for these devices in an essentially constant form for many years. See, for example, U.S. Pat. No. 2,001,317 issued to F. W. Slady on May 14, 1935. These cap-and-shell units often enclose one of several types of switches for energizing the lamp socket; e.g., key type (2- or 3-way), pull chain or push type. A thin insulating layer is used to separate the switch-socket member from the metallic enclosure. After extended use, or due to excessive heating from the lamp, the insulation may become charred, brittle or otherwise become ineffective. Alternatively, electrical leads may become loose and penetrate the insulation in some manner. When such failures occur, a person operating the lamp switch may be subjected to an electrical shock.

Only one cap-and-shell lamp socket is known which provides for the attachment of a ground wire. It is described in U.S. Pat. No. 1,974,049, issued to H. Hubbell, Jr., on Sept. 18, 1934. In that prior art unit, a terminal with a threaded screw is provided within the cap. This terminal is formed from a separate insert within the cap. Such a construction necessitates a modified insulation construction, cannot be installed in an already fabricated socket unit, and is relatively costly. It is probably these reasons that have prevented commercialization.

Accordingly, it is an object of my invention to provide a lamp socket unit that may be easily grounded through the attachment of a ground wire.

It is another object to provide a method of grounding a lamp socket unit that may be provided for in the manufacture of lamp socket units as well as in units already fabricated.

It is still another object to provide a tool for the fabrication of grounding means for a cap-and-shell type socket unit and for effecting the attachment of a ground wire

SUMMARY OF THE INVENTION

According to my invention, the cap portion of a metallic cap-and-shell lamp socket enclosure is provided with two generally parallel slits with the metal therebetween deformed inwardly so as to form a loop within the cap through which a ground wire may be passed. To effect the grounding of the enclosure, the loop is then deformed over the wire by a suitable tool so as to grip the ground wire and press the same against the inner surface of the cap. The original loop may be formed during fabrication of the socket unit or may be formed using the same ground-effecting tool on any previously fabricated socket unit.

DETAILED DESCRIPTION

Figure 1:
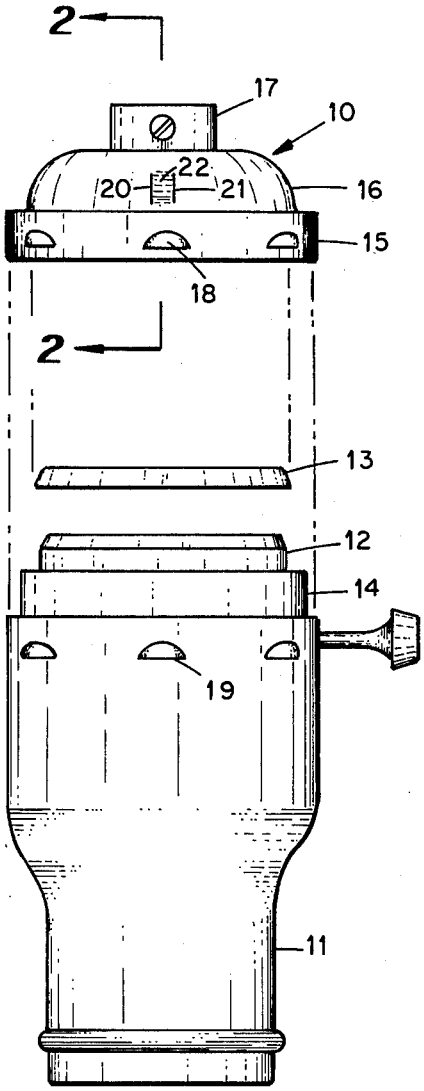
FIG. 1 is an exploded view of a cap-and-shell lamp socket unit illustrating the grounding means of my invention.

Referring now to FIG. 1, a generally conventional cap-and-shell socket unit is shown with the parts separated axially. The principal components are a socket base 10, a shell 11 and a socket-switch unit 12 for enclosure by the base and shell. The base and shell are formed from thin metallic members. It is also conventional to provide a thin cup-shaped insulation 13 within the base 10 as well as a thin cylindrical insulation 14 within the shell 11. The entire base 10, while generally referred to in the art as a "cap", is formed with a flange is for engagement with shell 11, a central hub or bushing 17 for attachment of the socket unit to lighting fixtures, and a curved cap 16 which joins the flange 15 and the bushing 17. The flange 15 contains indentations or tongues 18 for gripping with corresponding projections 19 on the shell 11. It is through the bushing 17 that electrical wires (see FIG. 2) normally enter the socket unit. In some units the electrical wires enter through a grommeted opening in the cap 16.

In this figure, my invention is represented by a pair of substantially parallel slits 20, 21 about ¼ in. (6 mm) long cut through the cap 16 and oriented in a generally radial array. The slits 20, 21 are spaced apart about ⅛ in. (3 mm) so as to produce a metallic strip 22 therebetween. The strip 22 is deformed inwardly about 1/16 in. (1.5 mm) from the normal contour of cap 16 so as to form an internal loop (see FIG. 2).

Figure 2:
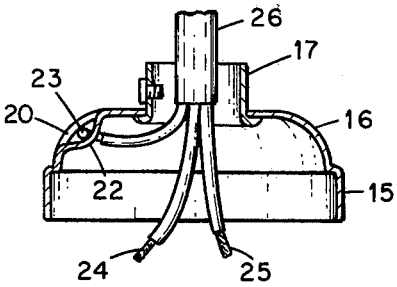
FIG. 2 is a cross sectional view of the base or cap portion of the unit of FIG. 1, taken at 2—2 thereof, prior to the attachment of a ground wire.
Figure 3:
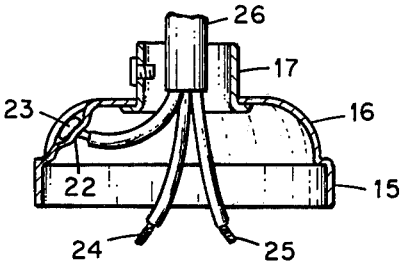
FIG. 3 is a cross sectional view of the base or cap portion of the socket unit after the attachment of a ground wire.
Figure 4:
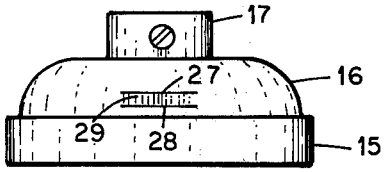
FIG. 4 is a front elevation of a cap portion of a socket enclosure illustrating another embodiment of my invention.

My invention is more clearly illustrated in FIGS. 2–4. In FIG. 2, which is taken at 2—2 of FIG. 1, the loop formed by strip 22 is clearly seen. The loop (22) is of sufficient size for the passage therethrough of at least a 14 ga. stranded ground wire 23. Wire 23 is one of three (23–25) of an electrical lead 26. FIG. 3 illustrates the method for effecting the grounding of socket base 10. After passage of wire 23 through the loop formed by strip 22, the loop is deformed in a reverse direction to securely clamp the ground wire 23 against the inner surface of cap 16. While this deformation may be accomplished by one of several tools, the tool described hereinafter is preferred.

FIG. 4 shows another embodiment of my invention. In this unit the cap 16 is provided with a pair of substantially parallel slots 27, 28 oriented in a circumferential array. As in FIG. 2, the strip 29 between slits 27, 28 is deformed inwardly to form a wire-receiving loop. As in FIG. 3, the loop (29) would be deformed in a reverse direction in order to clamp a wire (not shown) against the interior surface of cap 16.

The slits of FIG. 2 and 4 need not be exactly parallel. However, from a manufacturing standpoint, a parallel relationship may be preferred. The only limitation on the orientation, one to the other, is being able to easily deform the strip therebetween to form the loop. This is possible when the slits are "generally" parallel. As evidenced by the alternatives shown in FIGS. 2 and 4, the orientation of the loop is not critical to my invention and the choice depends upon the configuration of the tool used to produce the loop and then deform the same against a ground wire. In addition, although straight slits are shown and preferred, the slits may be curved, angular, etc. Futhermore, the dimensions cited above are not critical to my invention; any dimensions that produce a suitable ground wire engaging loop are satisfactory.

Figure 5:
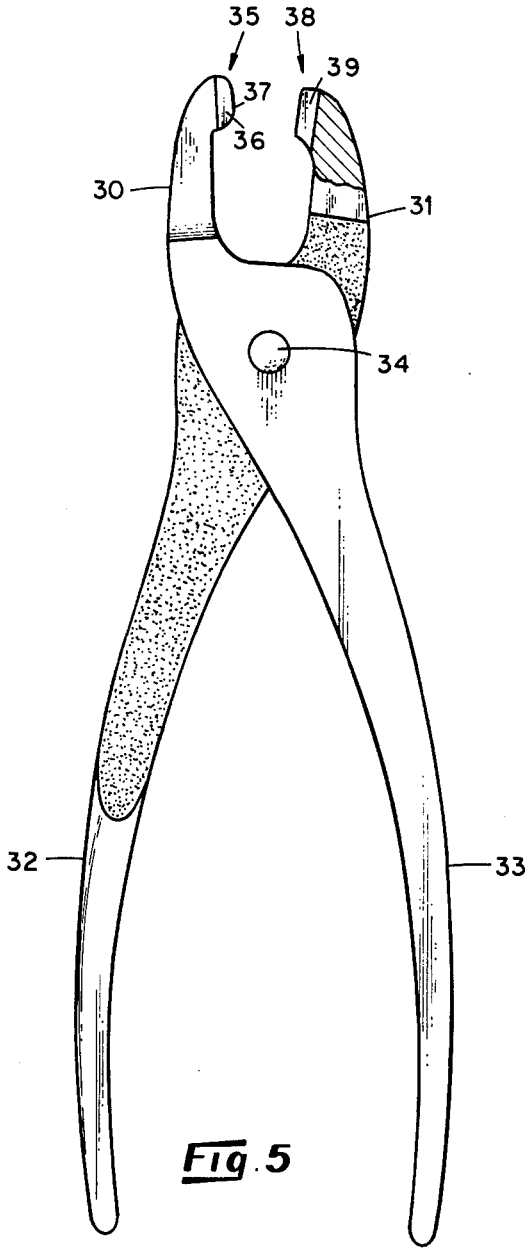
FIG. 5 is a drawing of a tool useful for forming the grounding means illustrated in FIGS. 1–4, and for effecting the attachment of a ground wire as in FIG. 3.

Shown in FIG. 5 is a tool useful for the forming of the abovedescribed loop from strip 22 of FIG. 2. The tool has the general form of pliers with a pair of jaws 30, 31, a pair of handles 32, 33 and a pivot 34 whereby movement of one handle toward the other produces a closing of the jaws. One jaw, e.g., jaw 30, is provided with a punch member 35 projecting toward the opposite jaw. Punch 35 is formed with two flat shearing surfaces 36 (one shown) and a generally hemielliptical outwardly-projecting surface 37 therebetween. Although preferably oriented as shown, the punch 35 may also be oriented at 90°, i.e., transversely to the jaw 30, to produce the strip 29 of FIG. 4.

Secured to the second jaw 31, or integral therewith, is a recess or die 38 oriented to accommodate the aforementioned punch 35. Die 38 is provided with a pair of shearing surfaces 40 (one shown) laterally separated by a width substantially identical to the width separating the corresponding shearing surfaces 36 of punch 35. The punch 35 and die 38 are similar to those described in U.S. Pat. No. 3,314,272.

Figure 6:
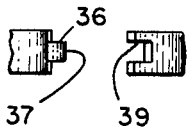
FIG. 6 is an end view of the jaw portion of the tool of FIG. 5.

FIG. 6 is an end view of the jaws 30, 31 more clearly showing the punch member 35 and the die 38.

The co-acting of shearing surfaces of the punch and die thereby produce the desired slits 20, 21 in cap 16. Surface 37 of the punch simultaneously produces the required grounding loop when the tool is positioned with the punch 35 on the exterior of the cap 16. It may be also seen that, with the tool positioned with the punch 35 inside the cap 16, the surface 37 will crimp a wire within the grounding loop according to my invention.

As stated above, the grounding loop in the cap 16 may be formed during normal fabrication steps. This may be in a single stamping step whereby the cap and the flange are formed, or in a separate step. Units fabricated without the loop, or units already in service, may be converted using the above-described tool or a similar device. In either case, the same tool may be used for effecting the connection between a ground wire and the loop of cap 16.

From the foregoing, it will be seen that an inexpensive and practical means is provided for the grounding of cap-and-shell lamp socket units by my invention. The units may be factory manufactured or converted to the improved type in the field by an electrician. The tool for accomplishing the conversion also serves as a tool for effecting the attachment of a ground wire. Furthermore, conventional insulation may be used to protect the terminals of the socket or socket-switch unit.

It should be understood that the figures and the specific description thereof set forth in this application are for the purpose of illustrating my invention and are not to be construed as limiting the invention to the precise and detailed specific structure. Rather, the invention is intended to include substantially equivalent constructions embodying the basic teachings and inventive concept of my invention.

I claim:

1. An improved lamp receptacle of the type wherein a thin metallic shell and base substantially surround a socket for receiving an end of a lamp, the base being provided with a flange for releasible engagement with the shell and a domed cap terminating in a central hub attached to the flange, the improvement comprising a crimpable inwardly deformed connector within the cap for receiving a ground wire, the connector being formed from a part of the cap.

2. The lamp receptacle of claim 1 wherein the connector is an elongated strip of metal formed from the cap by providing a pair of generally parallel slits in the cap and deforming inwardly the metal strip between the slits to produce an open loop within the interior of the cap to receive the ground wire.

3. The lamp receptacle of claim 2 wherein the strip of metal is about ¼ in. long and about 1/18 in. wide, and the midpoint of the strip is deformed about 1/16 in. within the cap.

4. The lamp receptacle of claim 2 wherein the strip of metal is oriented so that the long dimension thereof extends in a radial direction from the hub.

5. The lamp receptacle of claim 2 wherein the strip of metal is oriented so that the long dimension thereof extends circumferentially around the cap.

* * * * *